United States Patent [19]
Spry et al.
[11] 4,399,973
[45] Aug. 23, 1983

[54] CHRISTMAS TREE STAND

[76] Inventors: Robert H. Spry; Robert R. Spry, both of 513 E. Locust, Bloomington, Ill. 61701; Gloria Koller, Rt. #2, Pearl Rd., Spring Green, Wis. 53588

[21] Appl. No.: 407,333

[22] Filed: Aug. 12, 1982

[51] Int. Cl.³ ..... F16M 13/00

[52] U.S. Cl. ..... 248/524; 47/47; 248/529

[58] Field of Search ..... 248/522, 523, 524, 511, 248/518, 519, 525, 527, 528, 529; 47/42, 43, 47

[56] References Cited

U.S. PATENT DOCUMENTS

| | | | |
|---|---|---|---|
| 1,664,436 | 4/1928 | Tonnesen | 47/47 X |
| 1,766,094 | 6/1930 | Bauer | 47/47 |
| 2,931,604 | 4/1960 | Weddle | 248/527 X |
| 4,126,963 | 11/1978 | Dunbar | 248/523 X |

FOREIGN PATENT DOCUMENTS

| | | | |
|---|---|---|---|
| 2264474 | 10/1975 | France | 47/47 |
| 346721 | 7/1960 | Switzerland | 47/47 |
| 790369 | 2/1958 | United Kingdom | 47/47 |

*Primary Examiner*—J. Franklin Foss
*Attorney, Agent, or Firm*—Isaksen, Lathrop, Esch, Hart & Clark

[57] ABSTRACT

A stand (10) for supporting a Christmas tree (12) having a trunk (14) with a butt end (16). The stand includes a base (18) having an upwardly opening tree well (20) adapted to receive the butt end (16) of the trunk (14). The base (18) also has an upwardly opening support post well (34) and a support post (28) adapted to be rigidly engaged in the support post well in unturning relation in an upright position. A trunk brace (36) has a multiplicity of support post holes (40) adapted to slip over the end of the support post (28), to engage it in unturning relation. The support post (28) is adapted to so engage the sides of the support hole (40) through which it extends as to support the trunk brace (36) at a selected distance above the base (18) in rigid, unturning relation with respect thereto. A retention band (42) is adapted to bias and retain the trunk (14) against an engaging surface (38) of the trunk brace, securing the tree (12) in the stand (10).

14 Claims, 5 Drawing Figures

CHRISTMAS TREE STAND

BACKGROUND OF THE INVENTION

The present invention relates to stands for poles, trees, and the like, and, in particular, to Christmas tree stands.

DESCRIPTION OF THE PRIOR ART

The prior art is generally cognizant of stands for the temporary support of Christmas tress and the like. Examples include the stands shown in U.S. Pat. Nos. 2,613,899; 3,038,689; 3,227,405; 3,302,909; 3,353,773; 3,405,896; 3,480,241; and 4,222,545. Of these examples, U.S. Pat. No. 4,222,545 has a stand having a generally hemispheric configuration and an upwardly opening, tapered opening adapted to receive the base of a Christmas tree. The tree is then secured with wedges thrust into the tapered opening around the trunk. U.S. Pat. No. 3,038,689 shows a stand having a body that is cast from concrete. The cast body has a triangular, downwardly projecting recess adapted to receive the base of the tree trunk to be held therein. The base also has a low projection adjacent to the recess. A wire spring, rubber band, or rope may be tied around the tree trunk and projection to help clamp the trunk in place, in addition, a long, narrow wedge is adapted to be thrust between the tree trunk and a second projection that forms part of the concrete base. U.S. Pat. Nos. 3,353,773 and 3,405,896 are typical of the use of ropes or chains to guy the trunk of the tree being held so as to provide a point of support well up the trunk of the tree to hold the tree in a stable manner.

Nothing is known in the prior art showing a simple stand adapted to hold a Christmas tree or the like, without resort to wedges or guys, that securely supports the trunk of the tree at a point well above the stand and has a structure such that the tree may be quickly erected in the stand or removed therefrom without harm to the tree and with a minimum expenditure of time and labor.

SUMMARY OF THE PRESENT INVENTION

The present invention is summarized in that a stand for supporting a Christmas tree having a trunk with a butt end includes a base, surfaces of the base defining an upwardly opening tree well adapted to receive the butt end of the trunk of the Christmas tree. A support post of a selected length is also provided, the support post having a first and second end. Surfaces of the base define an upwardly opening support post well adapted to receive and hold the first end of the support post in an upright position, rigidly engaged in the support post well in unturning relation. The invention further includes a trunk brace having a substantially arcuate trunk engaging surface that is adapted to engage the trunk at a selected distance above the base in unturning relation. The trunk brace has surfaces defining a multiplicity of support post holes adapted to slip over and thus engage the second end of the support post. The invention includes means to support the trunk brace at a selected distance above the base in rigid, unturning relation with respect to the support post. A retention band is adapted to bias and retain the trunk against the engaging surface.

A primary object of the invention is to provide a stand for supporting a Christmas tree in which a Christmas tree can be quickly erected for display purposes with a minimum of manipulation by the user of the stand.

Another object of the invention is to provide such a stand in which the trunk of the tree is supported at a point well above the stand to provide stability.

A further object of the invention is to provide such a stand adapted to accommodate trees in which the trunk is not straight.

Another object of the invention is to provide such a stand that may also serve as a bird feeder when inverted and used in combination with the trunk of the tree after the tree is ready to be discarded.

A further object of the invention is to provide such a stand that can be economically manufactured from durable materials.

Yet another object of the invention is to provide such a stand in which the base of the tree may be immersed in water to help preserve the tree.

Other objects, advantages, and features of the present invention will become apparent from the following specification when taken in conjunction with the accompanying drawings.

DESCRIPTION OF THE PREFERRED EMBODIMENT

Figure 1:
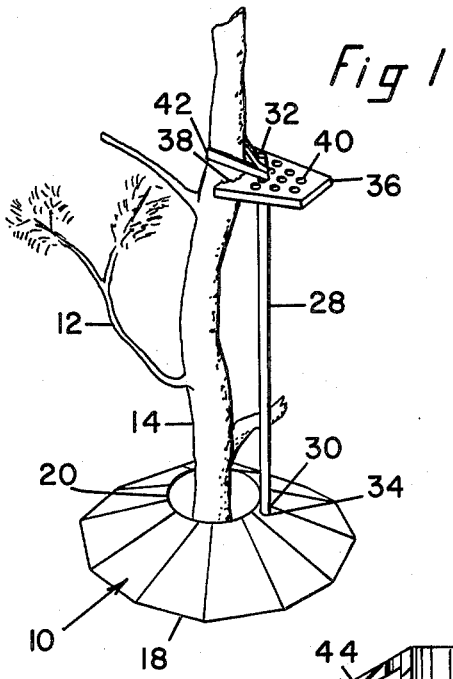
FIG. 1 is a perspective view of a stand for supporting a Christmas tree made in accord with the present invention.
Figure 2:
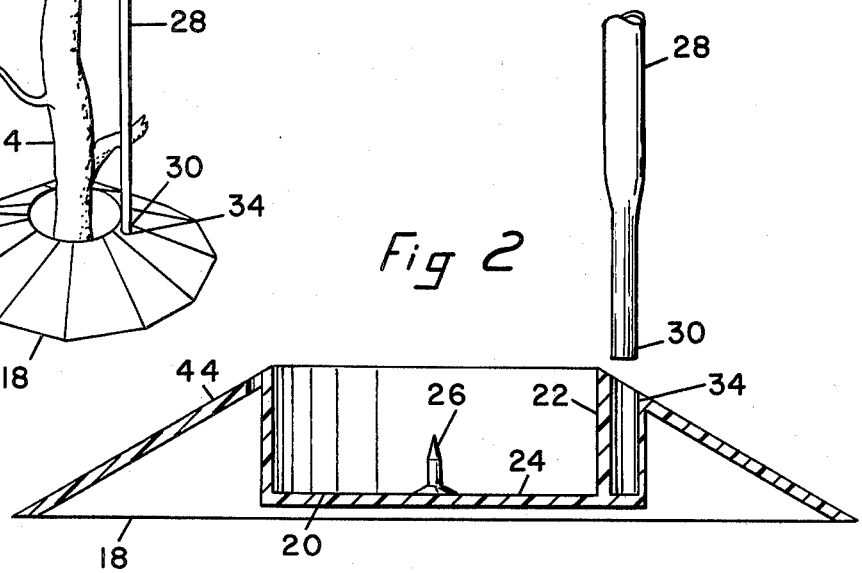
FIG. 2 is a cross sectional view of the stand of FIG. 1 taken along the line 2—2 of FIG. 1.

Referring more particularly to the drawings, wherein like numbers refer to like parts, FIG. 1 shows a stand for supporting a Christmas tree, generally indicated at 10, constructed in accord with the present invention. The stand 10 is adapted for use with a Christmas tree 12 having a trunk 14 with a butt end 16.

The stand 10 has a base 18 adapted to rest on the ground, floor, or other supporting surface. The base 18 may be hemispherical, a cube, or any convenient shape so long as the base has a selected thickness and width. Preferably, the base 18 is substantial conical, having a multiplicity of flat sides sloping upwardly from the periphery of the base towards its center, as is illustrated in FIG. 1.

Surfaces of the base 18 define an upwardly opening tree well 20. The size of the tree well 20 is selected to be such that the butt end 16 of the trunk 14 of the Christmas tree 12 to be supported by the stand 10 may be received therein. Preferably, the tree well 20 has sides 22 and a bottom 24 and is adapted to retain water. Preferably, an upwardly extending spike 26 is fastened to the bottom 24 and is adapted to engage the butt end 16 of the trunk 14 when it is received in the tree well 20.

The stand 10 also has a support post 28 having a selected length. The support post 28 has a first end 30 and a second end 32. Surfaces of the base 18 define an upwardly opening support post well 34. The support post well 34 is adapted to receive and hold the first end 30 of the support post 28 in an upright position. The first end 30 is adapted to be rigidly engaged in the support post well in unturning relation. Preferably, the first end 30 of the support post 28 has a selected, nonround cross sectional configuration, and the support post well 34 has substantially the same cross sectional configuration as the first end. Thus, the first end 30 may be inserted into the support post well 34 to be engaged therein in unturning relation. Any convenient, nonround cross sectional configuration may be used, but the preferred configuration is substantially elliptical.

Figure 3:
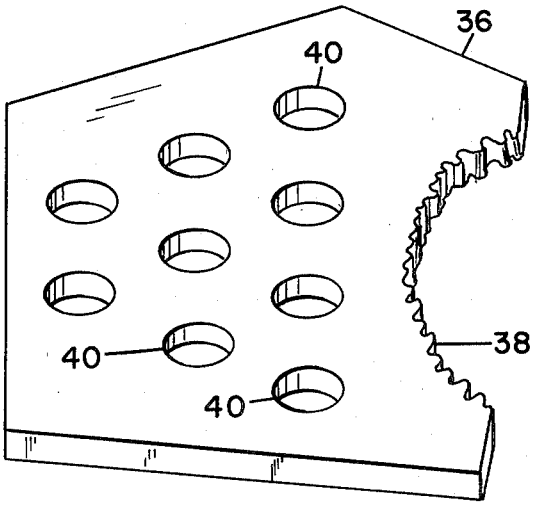
FIG. 3 is a perspective view of a trunk brace.
Figure 4:
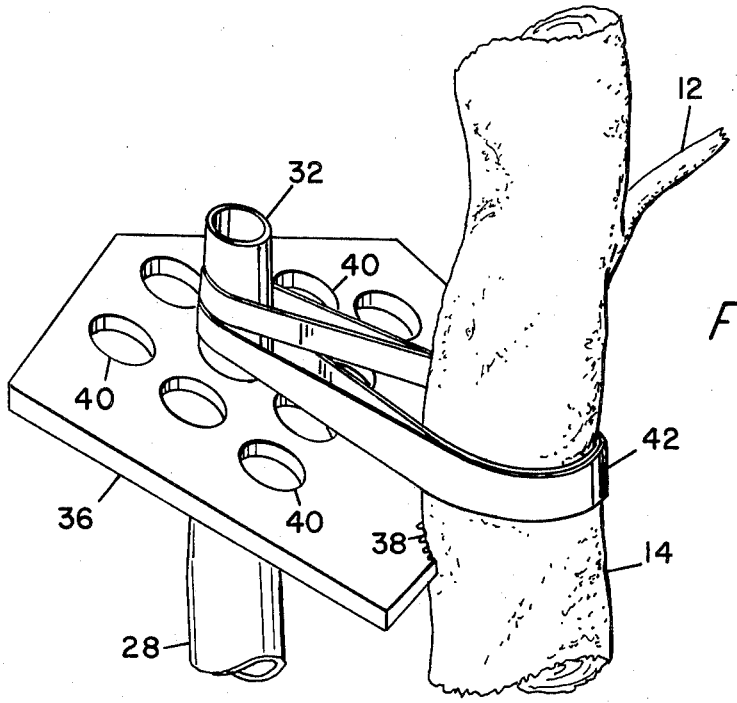
FIG. 4 is a perspective view of the trunk brace of FIG. 3 in place on the second end of the support post, with a tree trunk fastened thereto.
Figure 5:
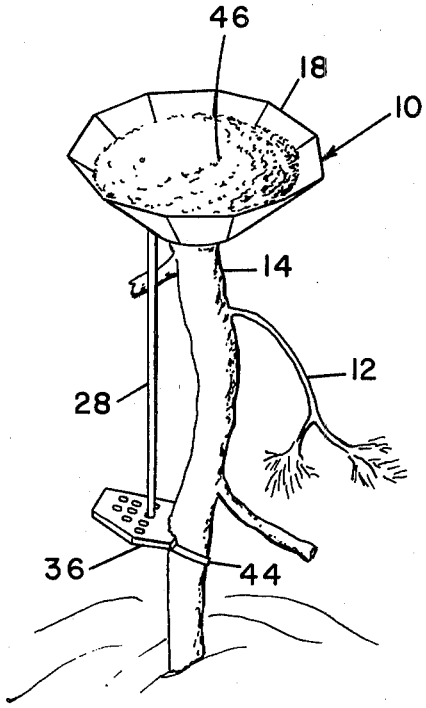
FIG. 5 is a perspective view of the stand showing a different use.

The stand 10 also includes a trunk brace 36. Preferably the trunk brace 36 is made of a substantially rigid, planar material of a selected thickness. The trunk brace 36 has a substantially arcuate trunk engaging surface 38, adapted to engage the trunk 14 at a selected distance above the base 18 in unturning relation. Preferably the trunk engaging surface 38 is serrated, as may be seen in FIG. 3, so as to more effectively grip the trunk 14 and accommodate the surface irregularities of the trunk.

The trunk brace 36 has surfaces defining a multiplicity of support post holes 40. The support post holes 40 are adapted to slip over and thus engage the second end 32 of the support post 28. The support post 28 has a selected, nonround cross sectional configuration for a selected distance from the second end 32 thereof. The support post holes 40 have substantially the same cross sectional configuration as the second end 32. Thus, the second end 32 may be engaged in a support post hole 40 in unturning relation, extending through the hole for a selected distance. Preferably, the cross sectional configurations of the second end 32 and of the support post holes 40 are substantially elliptical. The configurations of the first and second ends 30, 32 are so oriented that, when the first end 30 of the support post 28 is engaged in the support post well 34 and the second end 32 is engaged in a selected support post hole 40, the trunk engaging surface 38 is presented toward the trunk 14 of a Christmas tree 12 the butt end 16 of which is received in the tree well 20 of the base 18.

Preferably the support post 28 becomes increasingly large over a selected distance from the second end 32. Thus, at a selected distance from the second end 32, the size of the support post 28 becomes such that the support post contacts and comes to rest against the surfaces defining the support post hole 40 in which the second end is engaged. Thus, the nonround support post hole 40 and the corresponding nonround support post 28 having an increasing size over the selected distance from the second end 32 provide means to support the trunk brace 36 at a selected distance above the base 18 in unturning relation.

The support post holes 40 of the trunk brace 36 are so arrayed that the distance between the trunk engaging surface 38 and the support post 28 when the second end 32 is engaged in a support post hole 40 may be selected by choosing to insert the second end in a support post hole spaced at an appropriate distance from the trunk engaging surface. A first group of support post holes 40 located at selected distances from the trunk engaging surface 38 have a common orientation relative to lines normal to the trunk engaging surface and extending to the holes. A second group of support holes 40 each have an orientation different from that of the first group holes relative to a line normal to the trunk engaging surface 38 and extending to the hole of the second group. Thus, by selecting the appropriate support post hole 40, the trunk engaging surface 38 may be positioned at a selected distance from the support post 28 and be pointed at a selected angle to one side or the other of the support post, to accommodate a trunk 14 that is not straight.

A retention band 42 is adapted to bias and retain the trunk 14 against the engaging surface 38. Preferably, the support post 28 extends through and beyond the trunk brace 36 for a selected distance, and the retention band 42 is an elastomeric band, such as a conventional rubber band. The band 42 is adapted to be engaged first over that part of the support post 28 that extends through and beyond the trunk brace 36, then around the trunk 14 of the tree 12, and then back over that part of the second end that extends through and beyond the trunk brace. The length of the band 42 is selected to be such that the band, when so applied, is stretched to a selected extent. The trunk 14 is thereby biased against the engaging surface 38 and is retained against it in unturning relation.

In its operation, the stand 10 constructed in accord with the present invention is adapted to support a Christmas tree 12 on any substantially level surface, such as the ground or a floor. The base 18 is placed on such a surface, and the butt end 16 of the Christmas tree 12 is placed in the tree well 20. The spike 26 engages the butt end 16 to prevent lateral movement of the butt end within the tree well 20.

The support post 28 is then slipped into the support post well 34 to be held thereby in an upright position. The trunk brace 36 is placed against the trunk 14 with the trunk engaging surface 38 contacting the trunk. With the tree 12 held in the desired position by the user of the stand 10, the trunk brace 36 is held over the second end 32 of the support post 28, and the support post hole 40 that is located at a proper distance from the trunk 14 is selected by the user. The second end 32 of the support post 28 is then inserted through the selected support post hole 40, and the trunk brace 36 slid down the support post 28 until the sides of the post hole engage the support post, supporting the trunk brace.

With one hand still supporting the Christmas tree 12, the user of the stand 10 then selects a rubber band to be used as a retention band 42, hooks it over the exposed second end 32 of the support post 28, pulls it around the trunk 14, and hooks it again over the exposed second end. Upon the completion of this step, the Christmas tree 12 will be supported by the stand 10, and the user can release the tree and step away. The whole process is swift, easy, and requires a minimum of mechanical adjustment, making it a practical means for exhibiting Christmas trees for sale in an upright position, with the boughs falling naturally and attractively. The stand 10 may also be used for the ultimate display of the tree.

The tree 12 can be removed from the stand 10 with equal ease. With one hand supporting the tree 12, the user of the stand 10 merely slips the retention band 42 from the second end 32 of the support post 28, whereupon it snaps back and around the trunk 14, releasing the tree. Alternatively, the retention band 42 may be cut with the same effect.

In the event that the stand 10 of the invention is used for the ultimate display of the Christmas tree 12, the stand has a secondary use upon disposal of the tree. In many parts of the country, people feed birds in the winter months, sometimes using discarded Christmas trees thrust into snowbanks and the like as a rack on which to hang bread or other foods. However, by first snipping off a selected number of the upper branches of the tree 12, leaving the stand 10 in place, the tree and stand may be inverted and the trunk 14 thrust into a snowbank or the like. The inverted base 18 remains securely attached to the trunk 14 and is adapted to hold birdseed 46, or the like, and serve as a bird feeder. Surfaces of the base 18 define a drain 44 adapted to allow any water collecting in the inverted base to freely drain therefrom.

The base 18 may be conveniently manufactured by any conventional method of forming sheet materials. Thus, it may be stamped from metal or thermoformed from sheet plastics. Preferably, it is molded from thermoplastic material by conventional methods. The support post well 34 is preferably unitarily molded as a part of the base 18. Alternatively, a metal sleeve (not shown) may be fastened to a side 22 of the tree well 20 to serve as a support post well 34, so long as the method of fastening is sealed so as to not leak water placed in tree well 20, if that feature is desired. The support post 28 may be made of wood, metal, plastic, or any suitably strong and rigid material. The trunk brace 36 likewise may be made of any suitable rigid material. Preferably, it is punched from sheet metal or plastic or molded from plastic by conventional means.

In the preferred embodiment described above, the nonround cross sectional configurations of the first and second ends 30, 32 of the support post 28 and of the support post well 34 and support post holes 40 are all elliptical. However, any appropriate nonround cross sectional configuration would achieve the desired effect as disclosed and be within the scope and spirit of the invention. The trunk engaging surface 38 is preferably serrated, as is disclosed above. However, a nonserrated surface is also functional and is within the scope and spirit of the invention. Likewise, while the preferred embodiment of the retention band 42 is a conventional elastomeric band such as a rubber band, any band capable of biasing the trunk 14 against the trunk engaging surface 38 with sufficient force to retain it thereagainst is within the scope and spirit of the invention. The disclosed preferred means to support the trunk brace 36 at a selected distance above the base 18 in rigid, unturning relation has certain advantages in terms of simplicity of manufacture and use. However, a support post 28 supplied with an annular collar, pin, or other means for supporting the trunk brace 36 would also provide such support means within the scope and spirit of the invention.

It is understood that the present invention is not limited to the particular construction and arrangement of parts illustrated and disclosed. Instead, it embraces all such modified forms thereof as come within the scope of the following claims.

What is claimed is:

1. A stand (10) for supporting a Christmas tree (12) having a trunk (14) with a butt end (16), comprising:

(a) a base (18);

(b) surfaces of the base (18) defining an upwardly opening tree well (20) adapted to receive the butt end (16) of the trunk (14) of the Christmas tree (12);

(c) a support post (28) of a selected length having a first and a second end (30, 32);

(d) surfaces of the base (18) defining an upwardly opening support post well (34) adapted to receive and hold the first end (30) of the support post (28) in an upright position, rigidly engaged in the support post well (34) in unturning relation;

(e) a trunk brace (36) having a substantially arcuate trunk engaging surface (38), adapted to engage the trunk (14) at a selected distance above the base (18) in unturning relation, the trunk brace (36) having surfaces defining a multiplicity of support post holes (40) adapted to slip over and thus engage the second end (32) of the support post (28);

(f) means to support the trunk brace (36) at a selected distance above the base (18) in rigid, unturning relation with respect to the support post (28); and (g) a retention band (42) adapted to bias and retain the trunk (14) against the engaging surface (38).

2. The stand (10) specified in claim 1 wherein the first end (30) of the support post (28) has a selected, nonround cross sectional configuration, and the support post well (34) has substantially the same cross sectional configuration as the first end (30), whereupon the first end (30) may be inserted into the support post well (34) to be engaged therein in unturning relation.

3. The stand (10) specified in claim 2 wherein the selected nonround cross sectional configuration of the first end (30) of the support post (28) is substantially elliptical.

4. The stand (10) specified in claim 1 wherein the support post (28) has a selected, nonround cross sectional configuration for a selected distance from the second end (32) thereof; and the support post holes (40) have substantially the same cross sectional configuration as the second end (32), whereupon the second end (32) may be engaged in the support post holes (40) in unturning relation.

5. The stand (10) specified in claim 4 wherein the cross sectional configurations of the second end (32) and of the support post holes (40) are substantially elliptical.

6. The stand (10) specified in claim 5 wherein the size of the support post (28) increases over a selected distance from the second end (32) whereby the support post (28) is adapted, at a selected distance from the second end (32), to contact and come to rest against surfaces defining a selected support post hole (40) when the support post (28) is engaged therein, to support the trunk brace (36) at a selected distance above the base (18) in unturning relation.

7. The stand (10) specified in claim 4 wherein the support post holes (40) include a first group of support post holes (40) located at selected distances from the trunk engaging surface (38), each hole (40) of the first group having a common orientation relative to a line normal to the trunk engaging surface (38) and extending to the hole (40), and a second group of support post holes (40) each having an orientation different from that of the first group holes (40) relative to a line normal to the trunk engaging surface (38) and extending to the hole (40) of the second group.

8. The stand (10) specified in claim 1 wherein a part of the support post (28) is adapted to extend through and beyond the trunk brace (36) for a selected distance, and the retention band (42) includes an elastomeric band adapted to be engaged over that part of the support post (28) that extends through and beyond the trunk brace (36), then around the trunk (14) of the tree (12), and then back over the support post (28), the length of the elastomeric band being selected to be such that the band is stretched to a selected extent, thereby biasing and retaining the trunk (14) against the engaging surface (38).

9. The stand (10) specified in claim 1 wherein the tree well (20) has sides (22) and a bottom (24), and including an upwardly extending spike (26) rigidly fastened to the bottom (24) of the tree well (20) and adapted to engage the butt end (16) of the trunk (14) of the Christmas tree (12).

10. The stand (10) specified in claim 1 wherein the tree well (20) is adapted to contain water.

11. A stand (10) for supporting a Christmas tree (12) having a trunk (14) with a butt end (16), comprising:

(a) a base (18);

(b) surfaces of the base (18) defining an upwardly opening tree well (20) adapted to retain water and to receive the butt end (16) of the trunk (14) of the Christmas tree (12), the tree well (20) having sides (22) and a bottom (24) and an upwardly extending spike (26) rigidly fastened to the bottom (24) and adapted to engage the butt end (16) of the trunk (14);

(c) a support post (28) of a selected length having a first and a second end (30, 32);

(d) surfaces of the base (18) defining an upwardly opening support post well (34) adapted to receive and hold the first end (30) of the support post (28) in an upright position, rigidly engaged therein, the first end (30) of the support post (28) having a selected, nonround cross sectional configuration, and the support post well (34) having substantially the same cross sectional configuration as the first end (30), whereupon the first end (30) may be inserted therein to be engaged in unturning relation;

(e) a trunk brace (36) having a substantially arcuate trunk engaing surface (38) adapted to engage the trunk (14) at a selected distance above the base (18) in unturning relation, the trunk brace (36) having surfaces defining a multiplicity of support post holes (40), each adapted to slip over and thus engage the second end (32) of the support post (28), the second end (32) having a selected, nonround cross sectional configuration and the support post holes (40) having substantially the same cross sectional configuration as the second end (32), whereupon the second end (32) may be engaged in the support post holes (40) in unturning relation;

(f) means to support the trunk brace (36) at a selected distance above the base (18); and (g) a retention band (42) adapted to bias and retain the trunk (14) against the engaging surface (38).

12. The stand (10) specified in claim 11 wherein the cross sectional configurations of the second end (32) and of the support post holes (40) are substantially elliptical, and wherein the size of the support post (28) becomes increasingly large over a selected distance from the second end (32), the support post (28) being adapted, at a selected distance from the second end (32), to contact and come to rest against surfaces defining a support post hole (40) when the support post (28) is engaged therein and support the trunk brace (36) at a selected distance above the base (18).

13. The stand (10) specified in claim 11 wherein the support post holes (40) include a first group of support post holes (40) located at selected distances from the trunk engaging surface (38), each hole (40) of the first group having a common orientation relative to a line normal to the trunk engaging surface (38) and extending to the hole (40), and a second group of support post holes (40) each having an orientation different from that of the first group holes (40) relative to a line normal to the trunk engaging surface (38) and extending to the hole (40) of the second group.

14. The stand (10) specified in claim 11 wherein a part of the second end (32) of the support post (28) is adapted to extend through and beyond the trunk brace (36) for a selected distance, and the retention band (42) includes an elastomeric band adapted to be engaged over that part of the support post (28) that extends through and beyond the trunk brace (36), then around the trunk (14) of the tree (12), and back over the support post (28), the length of the elastomeric band being selected to be such that the band is stretched to a selected extent, thereby biasing and retaining the trunk (14) against the engaging surface (38).

* * * * *